United States Patent [19]

Arendt et al.

[11] 4,116,730

[45] Sep. 26, 1978

[54] SILICON-IRON PRODUCTION AND COMPOSITION AND PROCESS THEREFOR

[75] Inventors: Ronald H. Arendt, Schenectady, N.Y.; Patrick F. Aubourg, Arlington, Mass.

[73] Assignee: General Electric Company, Schenectady, N.Y.

[21] Appl. No.: 774,808

[22] Filed: Mar. 7, 1977

[51] Int. Cl.[2] ..... H01F 1/04

[52] U.S. Cl. ..... 106/113; 148/31.5; 204/40

[58] Field of Search ..... 148/113, 112, 110–111, 148/27, 31.5; 204/40, 37 R, 56 R, 100, 35 R

[56] References Cited

U.S. PATENT DOCUMENTS

| | | | |
|---|---|---|---|
| 3,054,732 | 9/1962 | McQuade | 204/37 R |
| 3,222,228 | 12/1965 | Stanley et al. | 148/31.5 |
| 3,676,227 | 7/1972 | Matsumoto et al. | 148/111 |
| 3,905,842 | 9/1975 | Grenoble | 148/111 |
| 4,030,950 | 6/1977 | Shilling et al. | 148/112 |

*Primary Examiner*—R. Dean
*Assistant Examiner*—John P. Sheehan
*Attorney, Agent, or Firm*—Charles T. Watts; Joseph T. Cohen

[57] ABSTRACT

A boron-containing magnesium hydroxide coating is electrolytically applied to a boron-containing electrical steel through the use of an electrolyte at 90° C which is an aqueous solution of magnesium acetate and magnesium metaborate containing magnesia as a solid second phase and having a pH in the range from 8.0 to 9.0.

3 Claims, 1 Drawing Figure

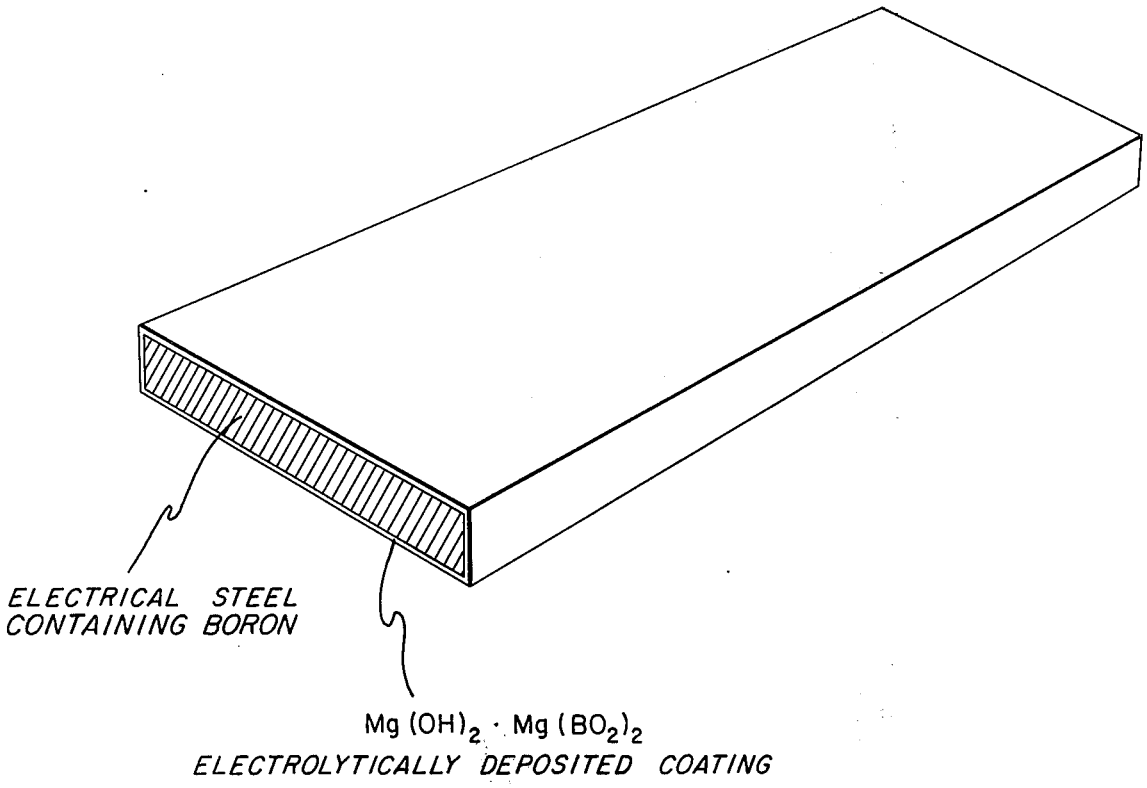
ELECTRICAL STEEL
CONTAINING BORON
$Mg(OH)_2 \cdot Mg(BO_2)_2$
ELECTROLYTICALLY DEPOSITED COATING

SILICON-IRON PRODUCTION AND COMPOSITION AND PROCESS THEREFOR

The present invention relates generally to the art of producing electrical steel and is more particularly concerned with a novel method of electrolytically depositing a boron-containing electrically insulating coating on a boron-containing silicon-iron magnetic sheet, with a new electrolyte composition for use in that method, and with the unique coated silicon-iron product made by that method.

CROSS-REFERENCE

This invention is related to the invention disclosed and claimed in U.S. patent application Ser. No. 774,807 filed of even date herewith in the names of Ronald H. Arendt and Matthew J. Curran entitled, "Coated Silicon-Iron Product and Process Therefor" and assigned to the assignee hereof and directed to the novel concept of providing a "duplex" refractory electrically insulating coating of a primary layer of an electrolytically deposited layer of a boron-containing magnesia.

This invention is also related to the invention disclosed and claimed in U.S. patent application Ser. No. 774,806 filed of even date herewith in the names of Ronald H. Arendt and Matthew J. Curran entitled, "Coated Silicon-Iron Product and Process Therefor" and assigned to the assignee hereof and directed to the assignee hereof and directed to the novel concept of providing a calcium metaborate coating on silicon-iron sheet or strip material by an electrolytic deposition process.

BACKGROUND OF THE INVENTION

Following the discovery by Grenoble (U.S. Pat. No. 3,905,842 granted Sept. 16, 1975, and assigned to the assignee hereof) that boron is effective in small but critical amount and in critical proportion to nitrogen in silicon-iron to promote secondary recrystallization during the final texture-developing anneal, Maucione (U.S. patent application Ser. No. 677,147, filed Apr. 15, 1976, and also assigned to the assignee hereof) found that the presence of a very small amount of boron in the coating on such a boron-containing steel further promotes secondary recrystallization and development of still better magnetic properties in the ultimate product. Maucione further found that the presence of boron in the coating can cause secondary recrystallization to take place when it otherwise would not, and also discovered that the presence of boron in the insulating coating was not effective in causing or promoting secondary recrystallization in the absence of boron in the metal itself at the outset of the final anneal.

Heretofore, in the practice of Maucione's teachings boron has been incorporated in the refractory oxide coating, usually magnesium hydroxide [$Mg(OH)_2$], provided in accordance with the process disclosed and claimed by McQuade in U.S. Pat. No. 3,054,732 by a dipping operation or by brushing a solution of a suitable boron compound on the coating, or even spraying it on.

SUMMARY OF THE INVENTION

In accordance with our discoveries to be described, it is possible to codeposit boron with magnesium hydroxide electrolytically under certain special circumstances. Such simultaneous deposition of $Mg(OH)_2$ and boron-containing compound in intimate admixture, or more likely as a solid solution, results in substantially more uniform distribution of boron throughout the coating than the prior dipping, brushing and spraying methods. Additionally, by this new process of ours one can exercise better control over the amount of boron incorporated in the $Mg(OH)_2$ coating, the proportions being established by the boron content of the electrolyte employed in the process, which is readily regulated. Still another important advantage of this new codeposition method is that the resulting product has a surface of substantially the same character as that of the coatings produced by the McQuade patent process and quite different from those resulting from dipping, spraying or brushing operations. In particular, the coated article or product of this invention is more amenable to fabrication operations involved in customary uses of this electrical steel material in that its coating does not tend to flake or spall as the material in sheet or strip form is laminated or coiled and successive layers or courses are moved in sliding contact with each other.

This new process of ours is predicated upon our discovery that a solution of magnesium acetate and magnesium metaborate containing magnesia as a dispersed solid second phase can be electrolyzed to provide on a silicon-iron cathode a coating in which boron is present in the desired amount and is uniformly distributed. This codeposition process is also based on our discovery that satisfactory coatings can be produced consistently by this process only if the electrolyte temperature is above about 65° C throughout the codeposition period. Additionally, we have found that this new electrolyte can be prepared by adding the requisite amount of boron in the form of boric acid to magnesium acetate solution containing magnesia as a solid second phase. Still further, we have found that continuous operations can be carried out by adding boric acid or other suitable source of boron (such as magnesium metaborate or magnesia containing boron in solid solution) to the electrolyte either continuously or intermittently to maintain the electrolyte magnesium metaborate content necessary to the deposition of a coating of the desired boron content.

From the foregoing, it will be understood that this invention has both method and article or product aspects and, in addition, has a composition-of-matter aspect. The method, as above indicated, centers in the novel feature of $Mg(OH)_2$ and a boron-containing magnesium compound electrolyte codeposition. The product is the $Mg(OH)_2$-coated boron-containing silicon-iron body produced by the codeposition process of this invention. Our new composition of matter is the electrolyte used in this process which consists essentially of an aqueous solution of magnesium acetate and magnesium metaborate having a pH between 8.0 and 9.0 and containing magnesia as a solid second phase.

Briefly described, then, the new method of this invention comprises the steps of providing a boron-containing electrical steel, electrolyzing an aqueous solution of magnesium acetate and magnesium metaborate of pH 8.0–9.0 with the silicon-iron sheet material being arranged as the cathode in the solution and with the solution being at a temperature of at least about 65° C and thereby covering the sheet with a boron-containing adherent electrically insulating coating, and subjecting the resulting coated sheet to a final heat treatment to develop (110)[001] secondary recrystallization texture in the silicon-iron sheet.

Similarly described, the article of this invention is the magnesia-coated, primary-recrystallized product of this process.

DETAILED DESCRIPTION OF THE INVENTION

As illustrated by the drawing accompanying and forming a part of this specification, this invention is carried out using a boron-containing electrical steel sheet substrate and applying thereto a coating of substantially uniform thickness of suitable refractory material having electrically insulating characteristics and containing magnesium metaborate substantially uniformly distributed throughout the coating.

As the initial step in the process, the substrate metal sheet is provided by preparing a silicon-iron melt of the required chemistry and then casting and hot rolling to intermediate thickness. Thus, the melt on pouring will contain from 2.2 to 4.5 percent silicon, manganese and sulfur in amounts in a ratio of manganese to sulfur less than 2.3, from about three to 50 parts per million boron and about 15 to 95 ppm nitrogen in the ratio range to boron of one and 15 parts to one, the remainder being iron and small amounts of incidental impurities including carbon, aluminum, copper and oxygen. Following anneal, the hot band is cold rolled with or without intermediate anneal to final gauge thickness and then decarburized.

The resulting fine-grained, primary recrystallized, silicon-iron sheet material in whatever manner produced is processed to provide the essential boron-containing coating of this invention in preparation for the final texture-developing anneal. Processing at this point involves the critical use of the applicants' present discoveries and this invention process of electrolytically codepositing $Mg(OH)_2$ and a boron compound source. With the sheet material connected as a cathode and the circuit as described in the above-referenced U.S. Pat. No. 3,054,732 and immersed in an electrolyte of this invention as described above, a uniform thickness coating (suitably about 0.05 to 0.4 mil and preferably about 0.2 mil) of $Mg(OH)_2.XMg(BO_2)_2.YH_2O$, $X = \leqq 1$, $Y =$ 0–15, is formed over that part of the sheet surface in contact with the electrolyte.

The electrolyte employed in this process is preferably prepared by adding boric acid to an aqueous magnesium acetate solution containing magnesia as a dispersed solid second phase. This magnesium acetate solution is suitably of 0.05 to 1.0 molar concentration and preferably about 0.2 molar strength. The pH of the electrolyte so produced will be between 8.0 and 9.0, reflecting the presence of excess magnesia. The amount of boric acid added is that which will provide the requisite boron content of the ultimate coating, which is preferably between 10 and 70 parts per million on the basis of the silicon-iron substrate, as disclosed and claimed in copending U.S. patent application Ser. No. 677,146, filed Apr. 15, 1976 and assigned to the assignee hereof. At the outset of the electrolytic codeposition step, the electrolyte is at a temperature above about 65° C, preferably about 90°–95° C, and throughout the period that codeposition is conducted the electrolyte is maintained at such elevated temperature.

As the final step of the process of this invention, the thus-coated sheet is heated in hydrogen or a mixture of nitrogen and hydrogen to cause secondary grain growth which begins at about 950° C. As the temperature is raised at about 50° C per hour to 1000° C, the recrystallization process is completed and heating may be carried on to up to 1175° C if desired to insure complete removal of residual carbon, sulfur and nitrogen.

The following illustrative, but not limiting, examples of our novel process as actually carried out with the new results indicated above will further inform those skilled in the art of the nature and special utility of this invention.

EXAMPLE I

Eleven-mil strips of silicon-iron of the following composition were prepared as described in U.S. Pat. No. 3,905,843, referred to above:.

Carbon: 0.030%
Manganese: 0.035%
Sulfur: 0.031%
Boron: 0.0010%
Nitrogen: 0.0050%
Copper: 0.24%
Aluminum: 0.005%
Iron: Remainder From this melt composition, 10.8 mil sheets were produced in a series of hot rolling passes followed by pickling and annealing of the intermediate thickness sheet material (about 100 mils) and cold rolling to 60 mils thickness, whereupon the material was reheated and cold rolled again to final thickness and the cold-worked sheet was given a decarburizing heat treatment at 800° C for 8 minutes in hydrogen (room temperature dew point).

Epstein strips cut from the sheet were immersed in an electrolyte prepared by adding boric acid to a slurry of magnesium acetate and magnesia in distilled water. The amount of boric acid added to the slurry was that which would provide 50 parts per million on the basis of the silicon steel of each strip in an electrolytically applied coating of mass density about 0.0275 ounce per square foot of steel surface. That amount in terms of concentration (moles per liter$^{-1}$) in the electrolyte was 0.0070 which represents 0.4317 liter$^{-1}$ $H_3BO_3$ calculated as follows:

M = desired mass density of electrolytically applied coating, oz.ft$^{-2}$ (steel)
$b$ = boron content of coating on basis of steel
G = thickness of strip (mils)

then:

$$[B] = b \times 10^{-6} \times G \times 2.54 \times 10^{-3} \times 7.65$$
$$= 1.9431 \times 10^{-8} \times b \times G \text{ g cm}^{-2} \text{ (steel)}$$
$$M' = M \times \frac{28.35}{(12 \times 2.54)^2} = 3.0516 \times 10^{-2} \times M \text{ g cm}^2 \text{ (steel)}$$

then:

$$Q = \frac{2 \times \frac{M'}{58.33}}{\frac{B}{10.811}}$$

Assuming the coating composition to be $$Mg_Q B_2O_{3+Q}$$

$C_{B+3}$ = boric acid concentration in the electrolyte, moles/liter$^{-1}$
$C^{\circ}_{Mg+2}$ = concentration of magnesium acetate per magnesium in electrolyte, moles/liter$^{-1}$ then:

$$C_B + 3 = \frac{2\,C^{\circ}_{Mg} + 2}{Q - 1}$$

$$Q = 29.65$$

$$C^{\circ}_{Mg} + 2 = 0.2 \text{ moles liter}^{-1}$$

$$C_B + 3 = \frac{0.2}{29.65 - 1.0} = 0.0070 \text{ moles liter}^{-1}$$

$$= 0.4317 \text{ liter}^{-1}\ H_3BO_3$$

The strips were made cathodes in electric circuits, 8 volts being applied across the terminals at a current density of 90 amperes per square foot for the 40-second duration of the electrolyzing period as 0.2 mil coatings of boron-containing $Mg(OH)_2$ were formed over the entire surfaces of the strips. On removal of the strips from the electrolytes, their coatings were observed to be uniform in thickness (about 0.2 mil) and smooth and hard as is typical of those $Mg(OH)_2$ coatings produced in accordance with the process of the referenced patent to McQuade (U.S. Pat. No. 3,054,732). It was found on test that these coatings contained boron in the form of $Mg(BO_2)_2$. 12 $H_2O$ distributed substantially uniformly throughout and in amount closely approximating 50 parts per million on the basis of the silicon-iron substrates. Franklin insulation values for these samples were uniformly about 0.2 ampere following annealing in hydrogen at about 1175° C for 8 hours.

EXAMPLE II

In another similar test of this invention process, 11-mil Epstein strips like those of Example I were coated by the procedure described just above except that the boric acid concentration of the coating solution or slurry was somewhat greater, the mass density of the electrolytically applied coating desired being only 0.004 oz.ft$^2$ (steel). Thus, as calculated above, 0.0604 moles liter$^{-1}$ or 3.7337 g. liter$^{-1}$ $H_3BO_3$ was added to the slurry. The resulting coated strips had the characteristics described in Example I except that the Franklin insulation values were not measured and the coatings were only about 0.03 mil in thickness, the deposition period being appropriately restricted to obtain that desired result as the other conditions stated above were approximately the same.

What we claim as new and desire to secure by Letters Patent of the United States is:

1. The method of producing grain-oriented silicon-iron sheet which comprises the steps of providing a fine-grained, primary-recrystallized silicon-iron sheet containing 2.2 to 4.5 percent silicon, between about three and 50 parts per million boron, and between about 15 and 95 parts per million nitrogen in the ratio to boron of one to 15 parts per part of boron, electrolyzing an aqueous 0.05 to 1.0 molar solution of magnesium acetate containing magnesium metaborate and magnesia with the silicon-iron sheet being arranged as the cathode in said solution and the said solution being at a temperature of at least about 65° C and thereby covering the sheet with an adherent electrically insulating 0.05 to 0.4 mil-thick coating of $Mg(OH)_2$ containing between about 10 and about 70 parts per million boron on the basis of the silicon-iron sheet, and subjecting the coated sheet to a final heat treatment at 950° to 1175° C in an atmosphere selected from the group consisting of hydrogen and a mixture of hydrogen and nitrogen to develop (110)[001] secondary recrystallization texture in the silicon-iron sheet.

2. The method of claim 1 in which the boron content of the silicon-iron sheet is about 10 parts per million and the nitrogen content of the said sheet is about 30 parts per million, and in which the magnesium acetate solution is of about 0.2 molar strength.

3. The method of claim 1 in which the electrolyte is maintained at a temperature between about 90° and 95° C throughout the period of electrolytic codeposition.

* * * * *